United States Patent [19]

Kuhns

[11] 3,953,277

[45] Apr. 27, 1976

[54] BOOKBINDER HAVING RESETTABLE STRIP GUIDES

[75] Inventor: Richard J. Kuhns, Barrington, Ill.

[73] Assignee: Xerox Corporation, Stamford, Conn.

[22] Filed: May 30, 1974

[21] Appl. No.: 474,839

[52] U.S. Cl. ..... 156/360; 11/1 AD; 156/477 B; 156/350

[51] Int. Cl.[2] ..... B42C 13/00; B42C 19/00

[58] Field of Search ..... 156/477 B, 357, 499, 156/351, 510, 361, 578, 366, 582, 378, 305, 538, 311, 475, 228, 552, 583, 551, 356, 566; 118/236, 242, 241, 503; 11/1 AD, 5, 1 B; 281/21 R; 93/36 MM, 56 PD; 269/135, 239; 74/100 R

[56] References Cited

UNITED STATES PATENTS

| | | | |
|---|---|---|---|
| 772,908 | 10/1904 | Ridderhof et al. | 74/100 R |
| 2,362,696 | 11/1944 | Hively | 269/239 |
| 2,660,148 | 11/1953 | Fogg | 156/477 B |
| 2,911,659 | 11/1959 | Robbins et al. | 156/477 B |
| 3,590,647 | 7/1971 | Monnich | 74/100 R |
| 3,616,074 | 10/1971 | Hoff et al. | 156/477 B |
| 3,689,352 | 9/1972 | Sugioka | 156/556 |
| 3,715,260 | 2/1973 | Dornemann et al. | 156/510 |
| 3,788,921 | 1/1974 | Polit et al. | 156/305 |

*Primary Examiner*—Douglas J. Drummond
*Assistant Examiner*—J. J. Gallagher

[57] ABSTRACT

Apparatus for applying a piece of adhesive strip to a stack of sheets having a thickness within one of several thickness ranges, the width of the adhesive strip to be applied being dependent on the thickness range to which the thickness of the stack of sheets corresponds. The apparatus includes a pair of strip guides and means, responsive to the thickness of the stack of sheets, for moving the strip guides to initial positions, said means including linkage means. The apparatus also includes: bipartite clamping means; and means, coupled to the linkage means, for moving the clamping means into engagement with the stack of sheets and for stressing play out of said linkage means, thereby moving the strip guides into one of a set of several sets of positions, each set corresponding to one of the thickness ranges. Each set of positions is suitable for supporting a different one of a plurality of adhesive strips, each strip having a different but standard size width. Binding of the engaged stack is accomplished with an arrangement of platens; means for rotating the clamping means, thereby moving an edge of the stack into abutment with one side of a supported strip, and for moving the other side of the adhesive strip into abutment with at least one of the platens; and means for biasing the platens against the other side of the strip to fix the strip to the stack of sheets.

8 Claims, 19 Drawing Figures

BOOKBINDER HAVING RESETTABLE STRIP GUIDES

The subject invention relates to bookbinding machines, and in particular to machines capable of applying an adhesive strip to a stack of sheets, the stack having a thickness within a predetermined thickness range.

Bookbinding machines, such as disclosed in U.S. Pat. No. 3,531,358, issued to H. Rost, are known wherein the edge of a stack of sheets is placed on a support surface and clamped; and wherein an adhesive strip is pressed by heated platens to the edge and to sections on the sides of the stack which are contiguous with the edge. Typically, the strip is fixed against the edge of the book by a fixed amount of relative motion between a platen and the edge, and side platens are moved orthogonally, with respect to the direction of the relative motion, to fix the strip to the side sections. It is noted that, in such machines, an adhesive strip having a width which is fully engaged by the side platens during the binding of a stack of sheets having a particular thickness are not suitable for commercially binding a stack of sheets having a smaller thickness because parts of the strip will not be engaged by the side platens. Alternatively, with stacks of sheets which are larger the heated side platens come in direct contact with adhesive squeezed out of the strip and with the sides of the stack, thereby marring the appearance of bound stacks. Thus, to provide commercially acceptable books the width of the strip used must be tailored to the thickness of the stacks of sheets to be bound.

Accordingly, it is an object of the present invention to provide bookbinding apparatus for binding stacks of sheets, having thicknesses within a thickness range, with adhesive strips having the same width, the resulting books having a commercially acceptable appearance.

It is another object of the present invention to provide bookbinding apparatus wherein clamping means are moved against the sides of a stack of sheets to hold the stack and, simultaneously, strip guides are moved to a position which is suitable for receiving a piece of adhesive strip having a standard width which is suitable for binding the stack of held sheets.

It is still another object of the present invention to position the strip guides so as to be suitable for receiving standard widths of adhesive strip cycle after cycle of operation.

In summary, the invention provides apparatus for applying a piece of adhesive strip to a stack of sheets having a thickness within one of several thickness ranges, the width of the adhesive strip to be applied being dependent on the thickness range to which the thickness of the stack of sheets corresponds. Structurally, the apparatus includes a pair of strip guides and means, responsive to the thickness of the stack of sheets, for moving the strip guides to initial positions, said means including linkage means. The apparatus also includes bipartite clamping means; and means, coupled to the linkage means, for moving the clamping means into engagement with the stack of sheets and for stressing play out of the linkage means, thereby moving the strip guides into one of a set of several sets of positions, each set corresponding to one of the thickness ranges, the one of a set of positions being suitable for supporting an adhesive strip having a width which is suitable for binding the engaged stack of sheets. Binding of the engaged stack is accomplished with an arrangement of platens; means for rotating the clamping means, thereby moving an edge of the stack into abutment with one side of a supported strip, and for moving the other side of the adhesive strip into abutment with at least one of the platens; and means for biasing the platens against the other side of the strip to fix the strip to the stack of sheets.

Additional objects and features of the invention will become apparent by reference to the following description in conjunction with the accompanying drawings, in which.

FIGS. 3–7 diagramatically show parts of the machine and their general movement during a binding cycle of the machine.

Figure 17:
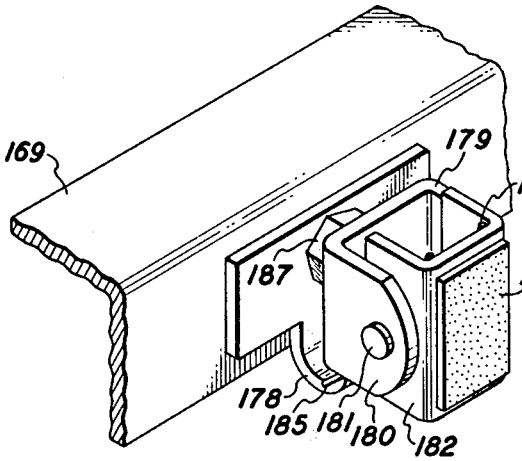
Figure 18:
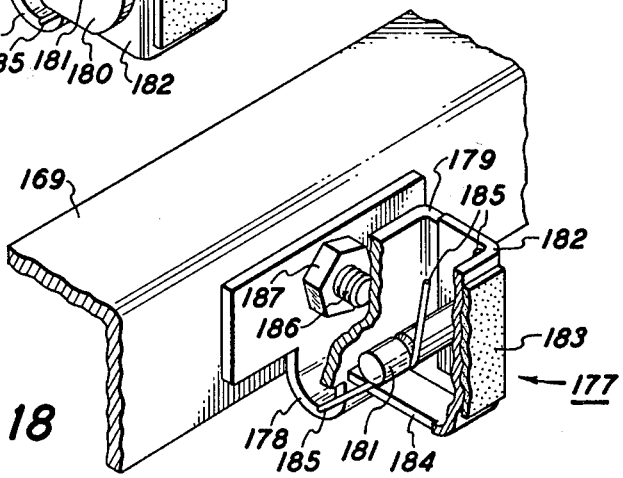
Figure 8:
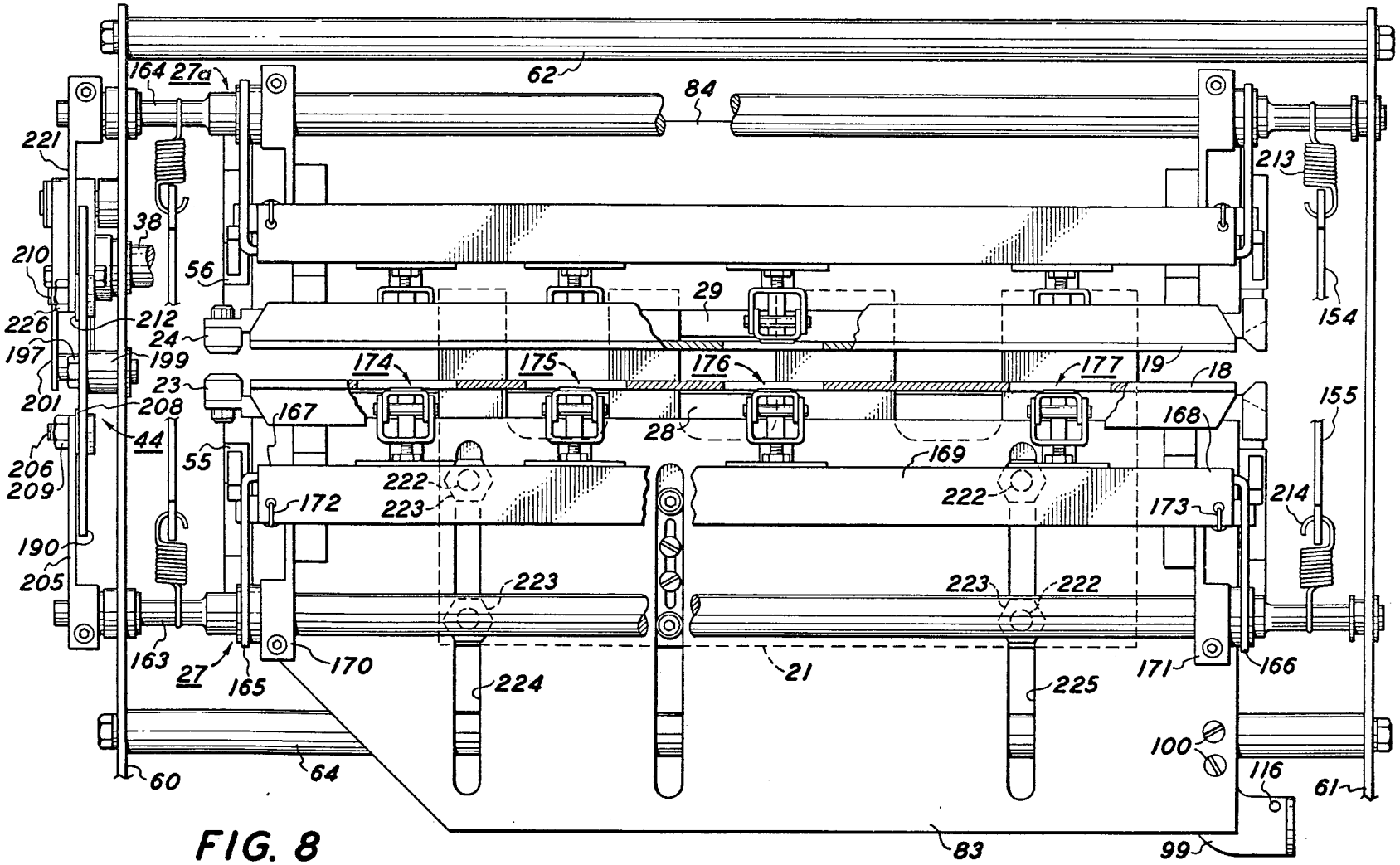
Figure 9:
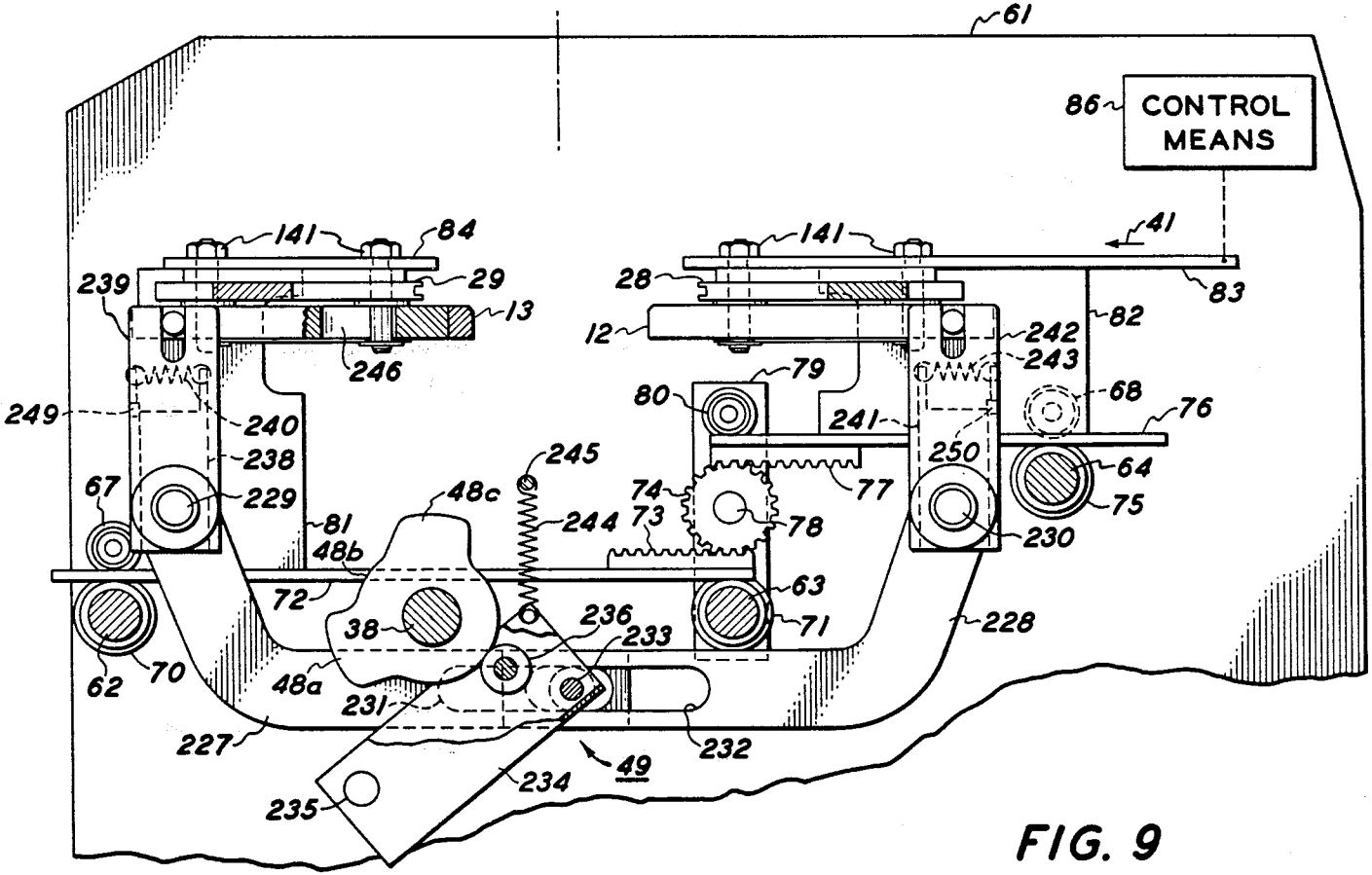
Figure 10:
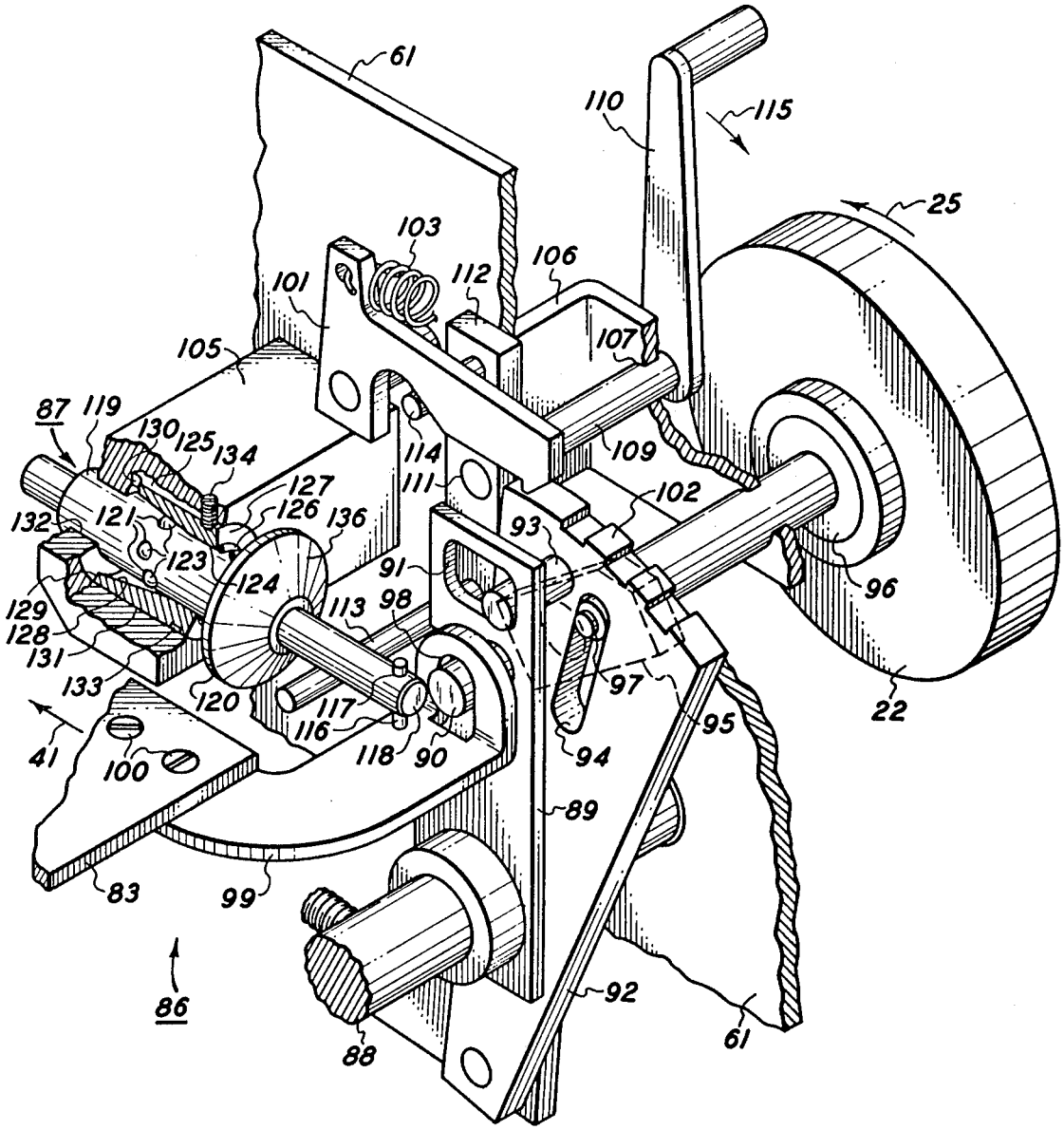
Figure 11:
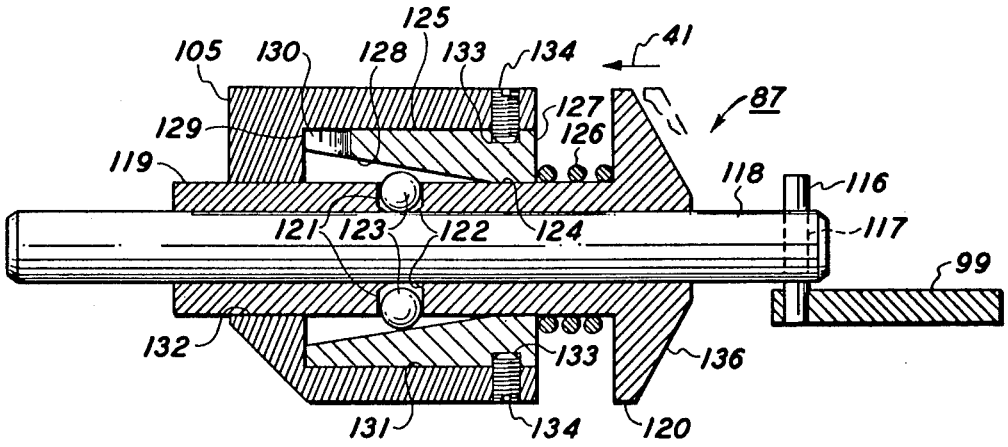
Figure 12:
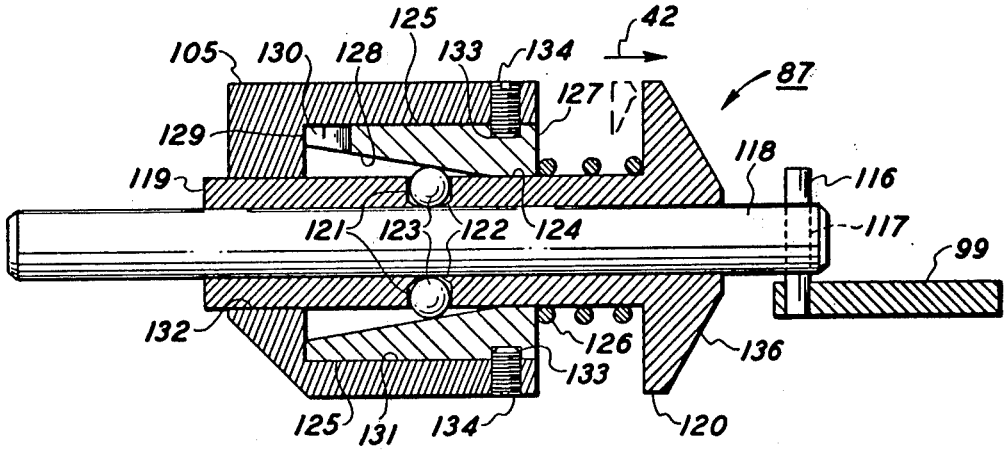
Figure 13:
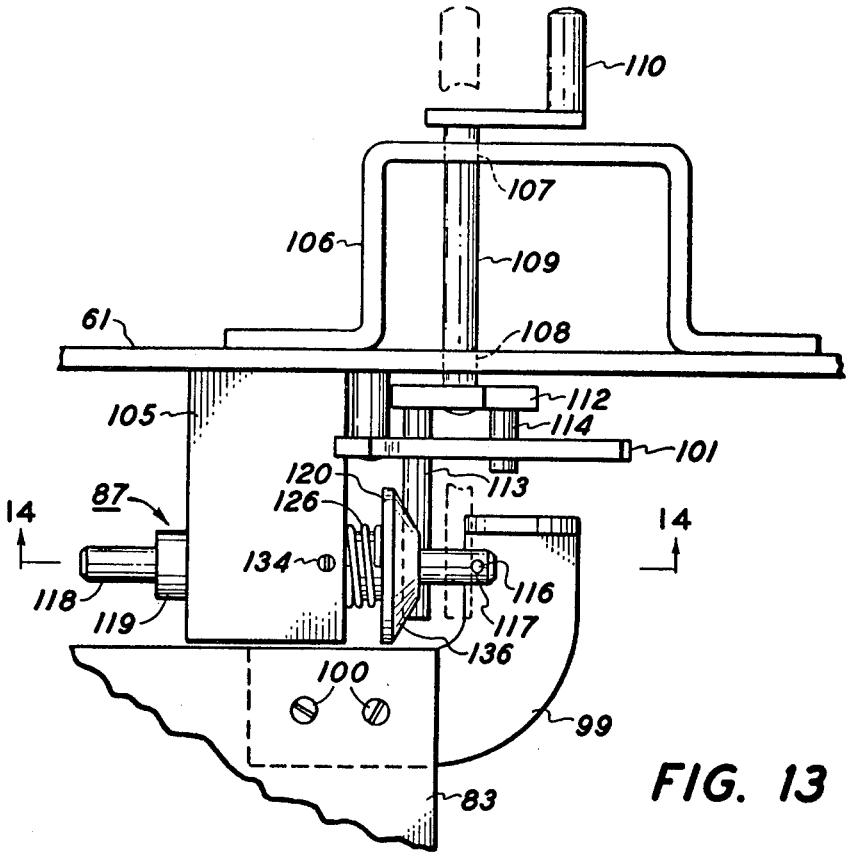
Figure 14:
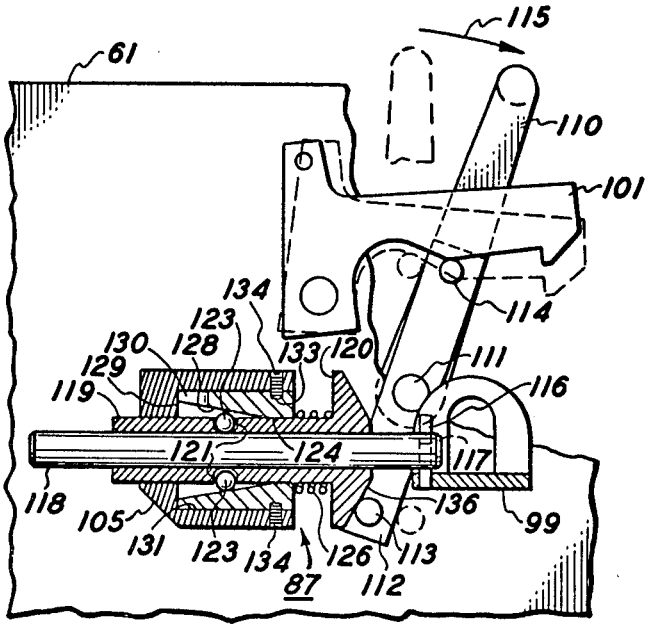
Figures 15, 16:
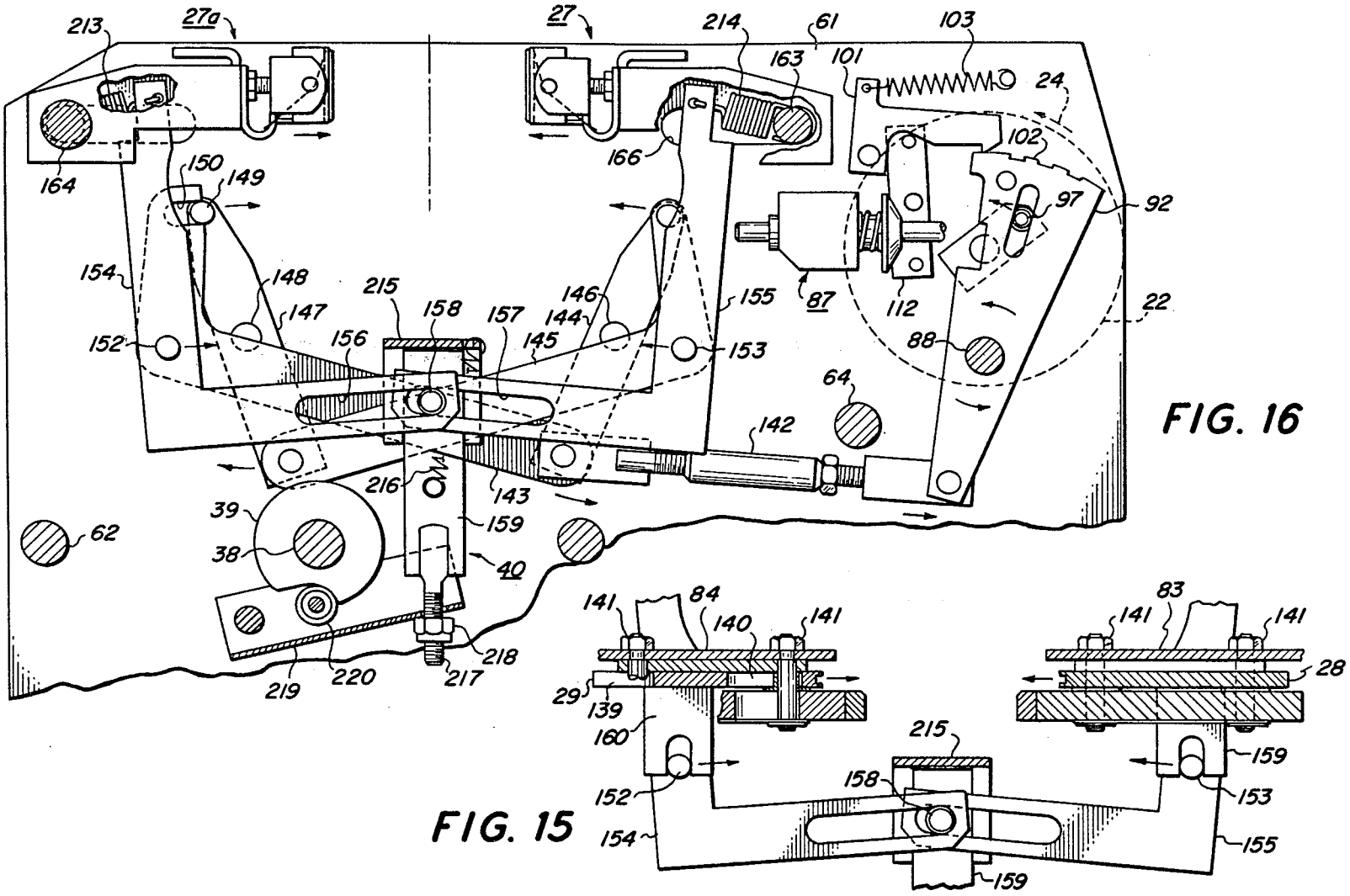
Figure 19:
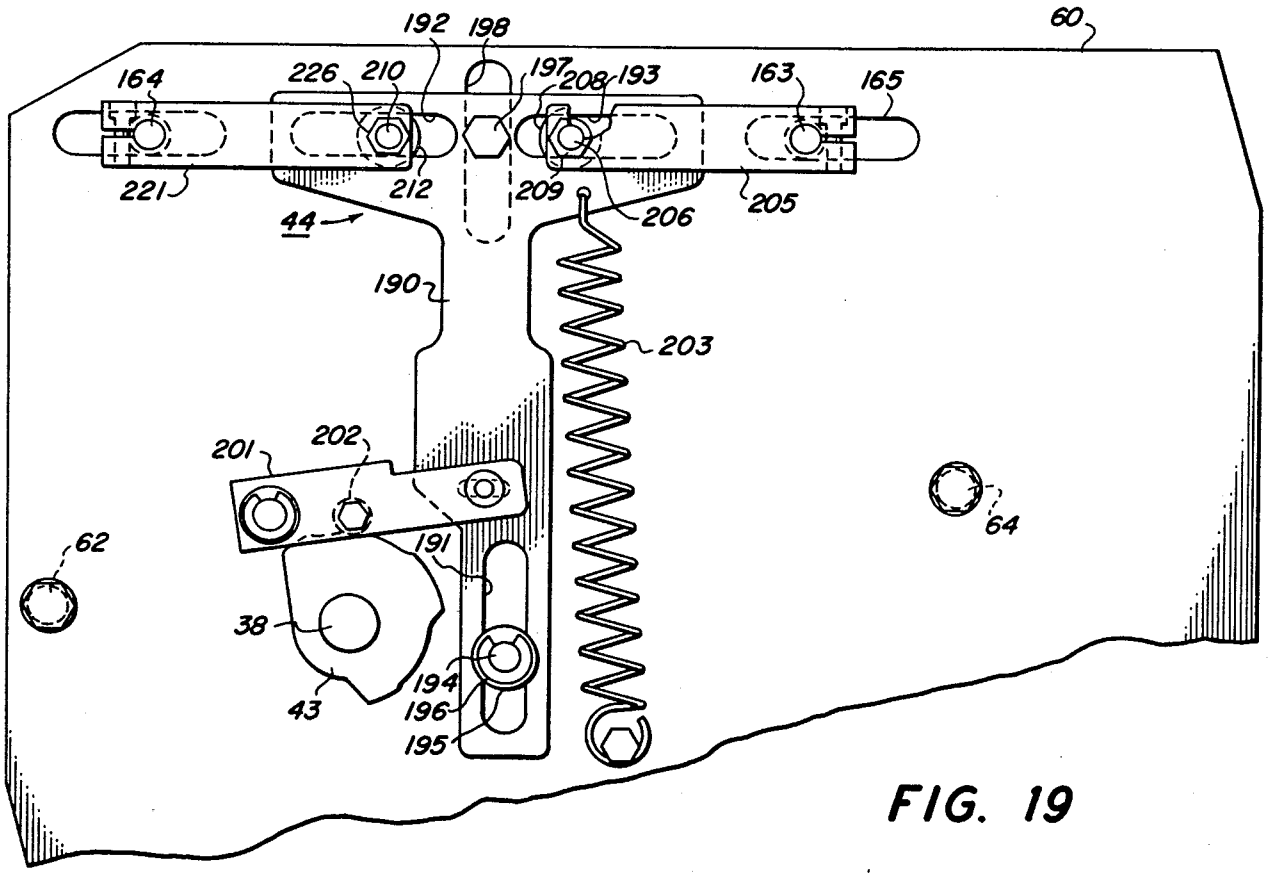

FIG. 8 shows a top plan view of structure in the machine, parts of the structure having been removed to more clearly show means for supporting the stack of paper sheets, means for clamping the stack, and means for vertically moving the stack;

FIG. 9 shows a side plan view of structure in the machine, parts of the structure having been removed to more clearly show platens and strip guides, within the machine, mounted on synchronously movable support plates, and means for driving the platens;

FIG. 10 is a partial perspective view of means for controlling the horizontal space between the support plates and between the strip guides, part of a component clutch having been removed to show its internal structure;

FIG. 11 is a cross-sectional view of the clutch when a rod thereof is sliding in one direction;

FIG. 12 is a cross-sectional view of the clutch when the rod is biased in the opposite direction;

FIG. 13 is a partial top plan view of the structure, showing, in an actuated position, a release mechanism of the control means;

FIG. 14 is a cross-sectional view taken along line 14—14 in FIG. 13;

FIG. 15 is a partial cross-sectional view of the support plates and linkage, responsive to the control means, for setting the horizontal distance between the strip guides;

FIG. 16 is a side plan view of the linkage coupled the control means to the clamping means and of means for moving the clamping means into and out of engagement with the stack of sheets;

FIG. 17 is a perspective view of a paper driver which forms part of the means for clamping the stack of paper sheets;

FIG. 18 is a perspective view of the paper driver, a portion having been removed to show its internal structure; and FIG. 19 is a side plan view of means for vertically moving the stack of paper sheets.

Figure 1:
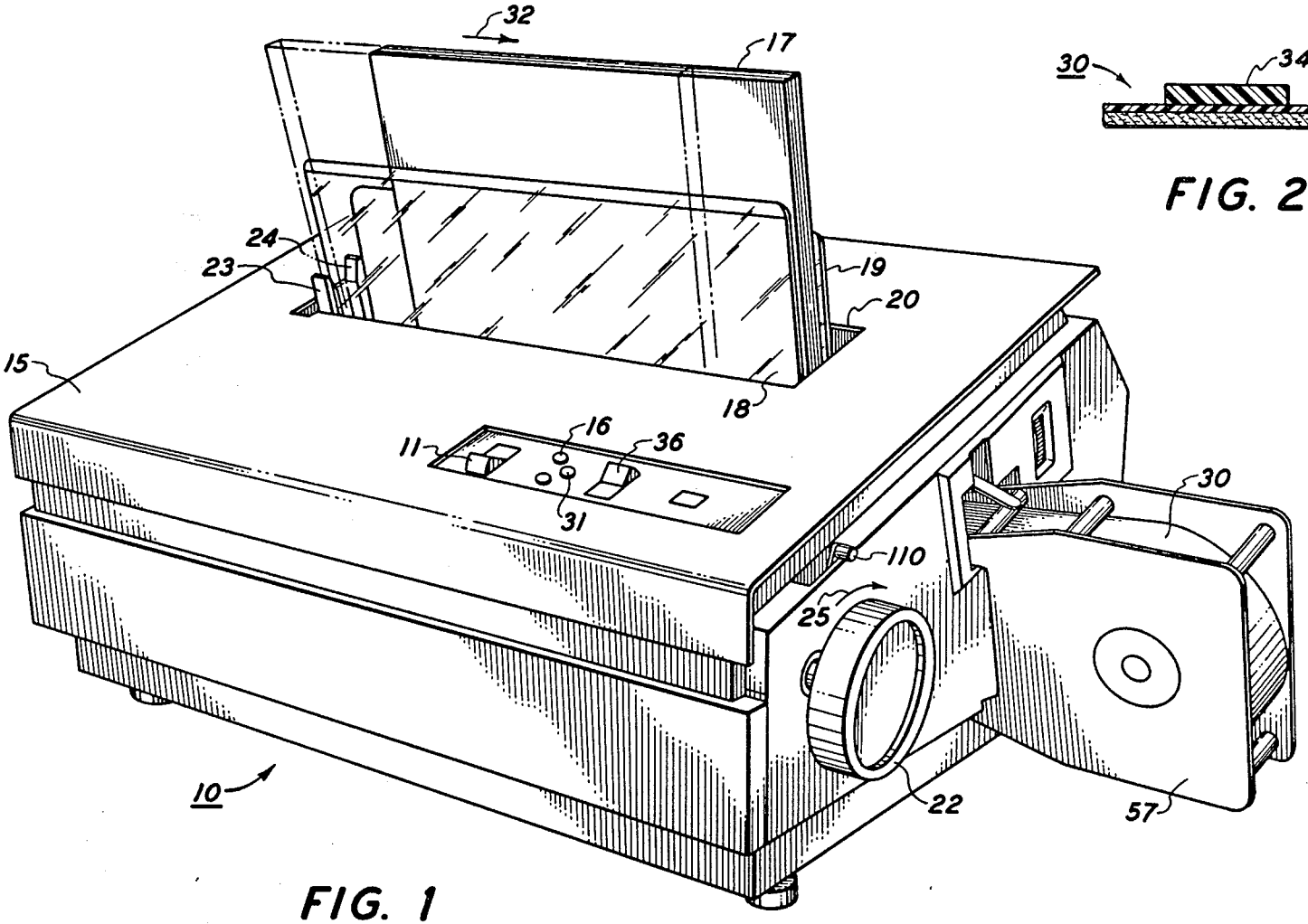
FIG. 1 is a perspective view of a bookbinding machine which includes the subject invention.

FIG. 1 shows a perspective view of a bookbinding machine 10 which embodies the subject invention. Machine 10 is capable of applying an adhesive bearing substrate of suitable length and width to an edge of a stack of paper sheets, thereby making a book. A functional description of how machine 10 operates is set forth below and is followed by a more detailed description of suitable structure for performing the functions described.

Figure 3:
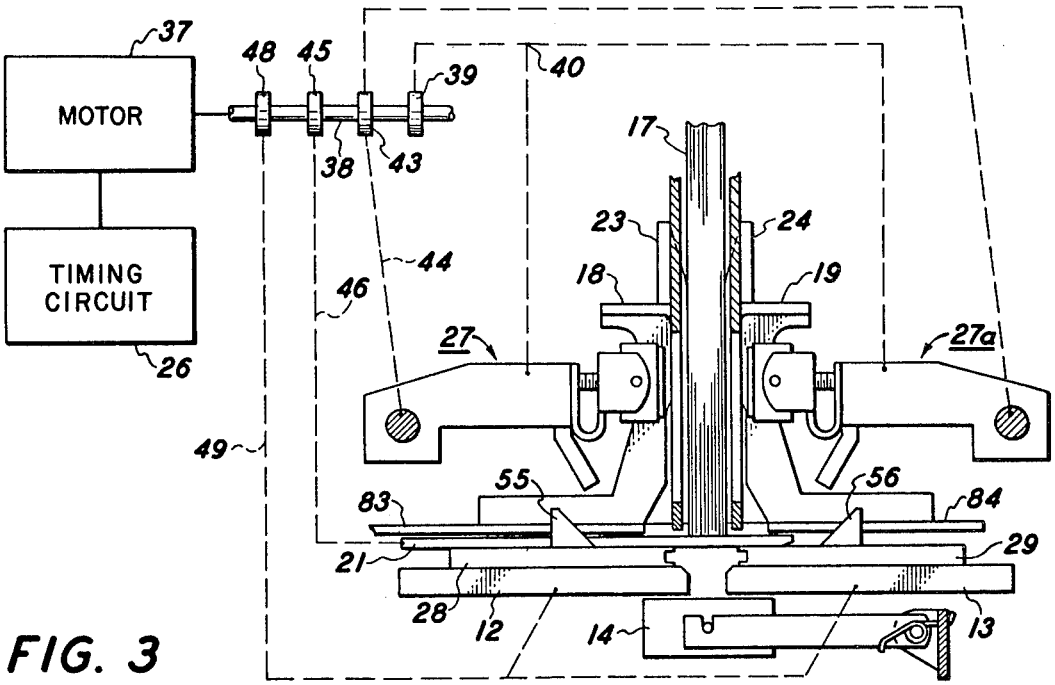
Figure 4:
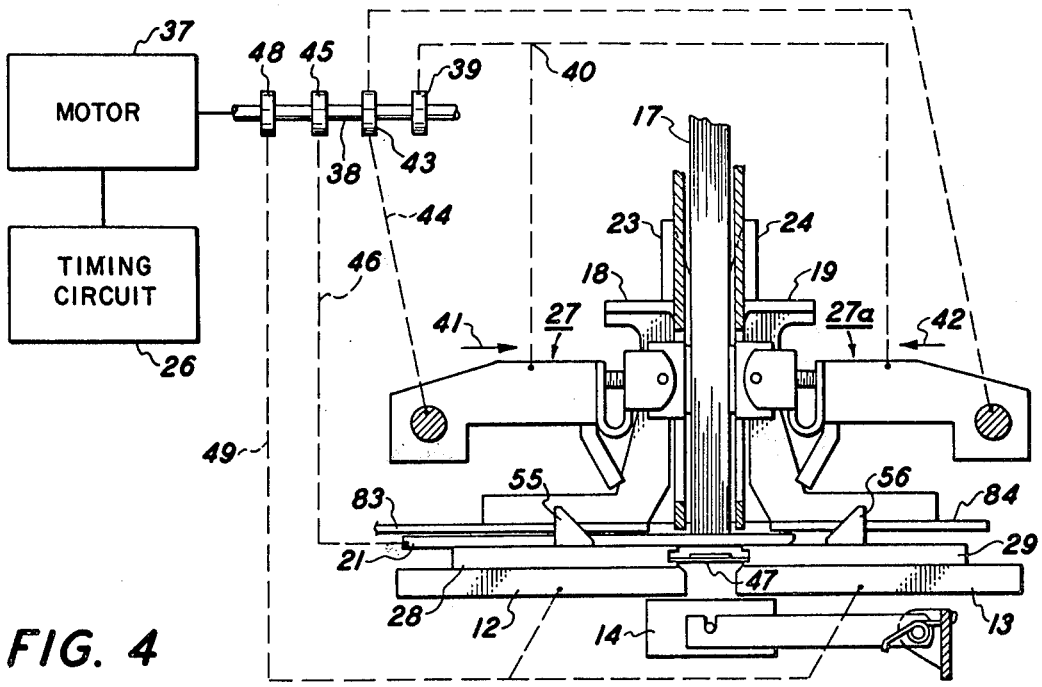

Referring to FIGS. 1 and 3, in the operation of machine 10 once a power switch 11 is actuated platens 12–14 within the housing 15 of the machine are heated with heating coils (not shown). Monitoring means (not shown) measure the temperature of the platens and when they reach a predetermined temperature an indicator light 16 turns on, thereby indicating that the machine is ready to perform a bookbinding cycle. To make a book a stack of paper sheets 17 to be bound is initially placed between page guides 18 and 19 at the extreme left end of the elongated slot 20 in the housing 15 (see dotted lines in FIG. 1). In this position, the pages rest on a movable plate 21 within the housing. The knob 22 is coupled to the page guides by a slip clutch and linkage, more fully described hereinafter, such that rotation of the knob in the direction of the arrow 25 causes the page guides 18 and 19 to be moved toward each other until a pair of caliper members 23 and 24 mounted on pages guides 18 and 19 respectively, abut and compress the stack of paper sheets 17. Thereafter, because of the resistance offered by the compressed stack of paper sheets and the use of a slip clutch, further rotation of the knob in the direction of arrow 25 has no effect on the spacing between the page guides 18 and 19 and the caliper members 23 and 24. Simultaneously with the movement of the page guides 18 and 19 and the caliper members 23 and 24 toward each other, rotation of the knob 22 in the direction of arrow 25 brings the heated platens 12 and 13 (see FIG. 3) toward each other and, therefore, the space between the platens 12 and 13 is determined by the thickness of the compressed stack of paper sheets. As will become apparent, this is significant because such a setting of the distance between platens 12 and 13 permit their use in the binding of stacks of different thicknesses with only a slight movement of the platens. A linear clutch (more fully described below) holds the page guides 18 and 19 and platens 12 and 13 in the position described while rotation of the knob 22 in the opposite direction moves bipartite means 27 and 27*a*, for clamping the stack of paper sheets 17, into position for clamping and moves strip guides 28 and 29 into a position (see FIG. 3) for receiving a suitable length of an adhesive bearing strip 30. As will appear, in this embodiment, three such positions are available for three selectable widths of the adhesive bearing strip, each width of strip being usable for binding a stack of paper sheets having a thickness within a correspondinng predetermined range.

After calipering, as described above, the stack of paper sheets 17 are moved, as indicated by arrow 32 in FIG. 1, to the extreme right of elongated slot 20 and actuate sensing means (not shown) which turn an indicator light 31 on if a cartridge 57 having an adhesive strip of suitable width for binding is operatively engaged with machine 10.

Figure 2:
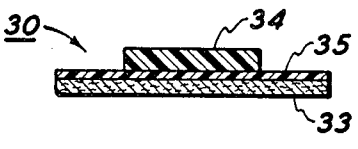
FIG. 2 shows a cross-sectional view of an adhesive strip usable with the machine to bind a stack of paper sheets.

As disclosed by the cross-sectional view of strip 30 (FIG. 2), the adhesive bearing strip 30 comprises a formable substrate 33 of, typically, relatively heavy paper stock, and adhesive coatings 34 and 35. Adhesive coatings 34 and 35 constitute a plurality of strip-like formations comprising two heat activated adhesive types. Heat activated adhesives may be either of the low or high tack types. A low tack adhesive comprises an adhesive material which when heated becomes fairly molten or fluid, thereby providing a high degree of surface wet-out with a minimum application of pressure or heat. A typical low tack adhesive may be a mixture of about 80% by weight of an ethylene/vinyl acetate copolymer having a 90% ratio of ethylene to vinyl acetate and about 20% by weight of rosin acid ester. A high tack adhesive comprises an adhesive material which when heated remains highly viscous and somewhat immobile so that a definite amount of heat is necessary to wet-out a surface being adhered. A typical high tack adhesive may be a mixture of polyethylene, a rosin acid, and a metal salt of a carboxylic acid, present in weight proportions of 80/10/10, respectively. High tack adhesives have the advantage that, on application of heat and pressure, the bond created thereby immediately possesses a high degree of strength. On the other hand, the low tack adhesives have the advantage that on application of heat and pressure the adhesive flows readily or is wicked into the edges of the paper sheets to be bound. The strip 30 preferably has the high tack adhesive 35 uniformly applied to the substrate 33 while the low tack adhesive 34 is applied along the center line of the substrate with a relatively greater thickness than that of the high tack material. Typically, the width of the adhesive 34 is approximately equal to or slightly greater than the overall compressed thickness of the stack of sheets to be bound. For a more detailed description of the strip material, reference may be had to a U.S. patent application, Ser. No. 196,446, filed Nov. 1, 1971 by Donald W. Watson.

Figure 5:
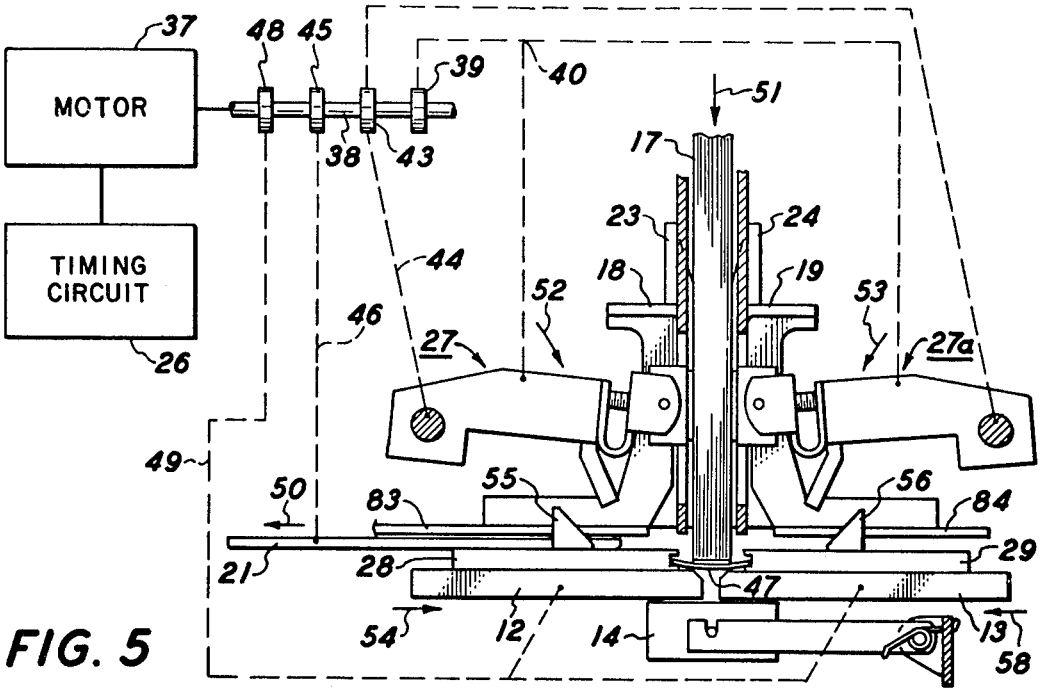
Figure 6:
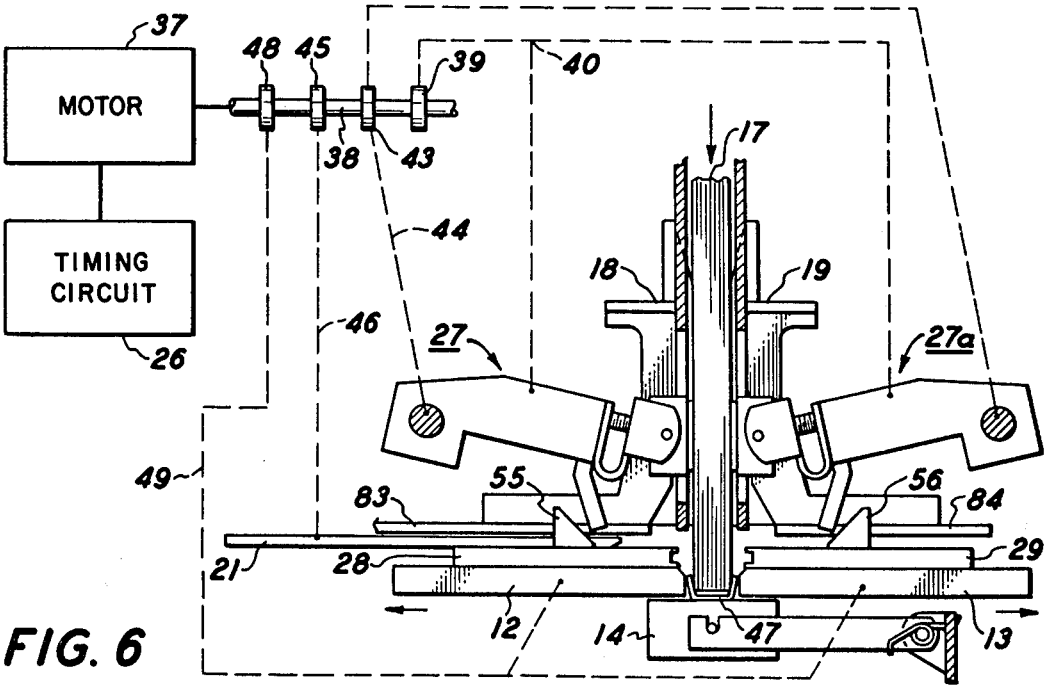

Referring again to FIG. 1, with suitable adhesive strip in the cartridge, actuation of a "bind button" 36 initiates an automatic binding cycle. More specifically, when button 36 is pressed a main drive motor 37 (see FIG. 3) is energized and rotates a main drive shaft 38 of the apparatus. A cam 39 carried by the main drive shaft effects movement of suitable linkage 40 resulting in movement of the clamping means 27 and 27*a* as indicated by arrows 41 and 42 in FIG. 4 and clamping of the stack of paper sheets 17. To this end, the page guides 18 and 19 are provided with suitable openings through which part of the clamping means move. After clamping, the main drive motor 37 is automatically de-energized by a timing circuit 26 for a predetermined period of time in order that an automatic strip inserter, such as described in a U.S. patent application, Ser. No. 392,583, filed on Aug. 29, 1973 by R. J. Kuhns, can insert a measured section 47 of strip 30 into the channel-shaped guides 28 and 29. Upon re-energization of the motor 37 a cam 43 carried by shaft 38 drives the linkage 44, thereby rotating the clamping means and lifting the stack of paper sheets 17 from the movable plate 21 enough so that the plate 21 can be retracted from its page holding position by a cam 45 carried by the shaft 38 and connected by linkage 46 to the plate. Thereafter, the stack of paper sheets 17 can be plunged or moved in the direction of the heated platens 12–14. Referring to FIG. 5, simultaneously with the retraction of the plate 21 (see arrow 50), the lifting of the stack of paper sheets 17, and subsequent movement, as indicated by arrows 51–53, of the sheets downward, the platens 12 and 13 are moved toward each other by a cam 48 on shaft 38 and linkage 49 (see arrows 54 and 58). The cams 39 and 48 are designed to bring the stack of paper sheets into abutment with the strip section 47 and to move strip section 47 against the heated platens 12 and 13. Strip section 47 remains in contact with the top surfaces of the heated platens 12 and 13 for a period ot time sufficient to effect preheating and softening thereof. After strip section 47 has been heated, the cams 43 and 48 effect a slight lifting of the stack of paper sheets and a separation of platens 12 and 13 sufficient to snugly accommodate the thickness of the compressed stack of sheets and the strip section. The stack of paper sheets 17 are then moved downwardly (see FIG. 6) and press strip section 47 into contact with heated and resiliently mounted bottom platen 14. Thereafter, platens 12 and 13 are biased against the strip section for a period of time sufficient to soften the high tack adhesive, thereby fixing the strip section to the sides of the stack of sheets. After the high tack adhesive has been softened the platens 12 and 13 are partially opened and "Cooking" of the low tack adhesive continues for a predetermined period of time. During this period the main motor is stopped by the timing circuit 26. Subsequently, the main motor is again energized and platens 12 and 13 are fully opened by cam 48 and linkage 49. Sequentially, the resulting book is then lifted to a position slightly above plate 21, plate 21 is returned to its book supporting position, and the resulting book is moved downwardly until it rests on the plate. Thereafter, the clamping means 27 and 27*a* are retracted from engagement with the book and the main motor is de-energized. The bound book can now be removed from the binding apparatus. It should be noted that in this plunge of the stack of paper sheets the clamping means are brought against abutment means 55 and 56 mounted on strip guides 28 and 29, respectively. Further, abutment means 55 and 56 are sloped to limit the plunge in proportion to the thickness of the stack of paper sheets. With this arrangement platens 12 and 13 always fix edge sections of the strip section against the sides of the stack of paper sheets and, consequently, a single width of strip section can be used to bind a stack of paper sheets within a predetermined thickness range.

Structurally, the machine 10 includes within housing 15 a frame (see FIG. 8) comprising upright frame plates 60 and 61 held in parallel by tie bars 62–65 and fasteners.

Referring to FIGS. 8 and 9, each of tie bars 62 and 63 include a pair of flanged bearings 70 and 71 (only one of each pair being shown) which support a driven plate 72 bearing a horizontally disposed rack 73. Rack 73 is engaged with a gear 74 rotatably mounted on a shaft 78 coupled (not shown) to the frame plates, the gear being above the rack. Gear 74 and a flanged bearing 67, supported by a bracket (not shown) connected to tie rod 62, engaged with the top of the plate 72 hold the plate down. Gear 74 in combination with a tie bar 64 bearing a pair of flanged bearings 75 (only one shown) support a driven plate 76 having on its underside a horizontally disposed rack 77, rack 77 being engaged with gear 74. To maintain rack 77 in engagement with gear 74 a pair of brackets 79 (only one shown) connected to tie bar 63 and shaft 78 each rotatably support flanged bearings 80 (only one shown) against the upper side of drive plate 76. Further, a flanged bearing 68, supported by a bracket (not shown) to tie rod 64, cooperates with flanged bearing 75 to hold plate 76 down. Plates 72 and 76 carry spacers 81 and 82 which maintain in a horizontal plane support plates 84 and 83, respectively. In turn, plates 83 and 84 support page guides 18 and 19, respectively (see FIG. 3). Thus, movement of support plate 83 in the direction indicated by arrow 41 causes rack 77 to rotate gear 74 and gear 74 moves page guide 19 toward approaching page guide 18. Movement of support plate 83 in a direction opposite to arrow 41 causes the page guides to move apart. Lateral motion of the plates 72 and 76 with respect to arrow 41 is prevented by the flanged bearings shown in engagement with one set of edges of the plates and engagement of an opposite set of edges on the plates by the flanged bearings which are not shown. Support plate 83 is connected to means 86 for controlling the horizontal space between plates 83 and 84.

Referring to FIG. 10, the control 86 means include a horizontally disposed rod 88 rotatably connected (shown in part) to frame plates 60 and 61. Rod 88 rotatably supports a radial link 89 having a pin 90 parallel to rod 88 and a hole 91. In addition, rod 88 rigidly supports a ratchet 92 having a radially disposed oblong hole 94 and a pin 93 which extends, with clearance, through hole 91. Pin 90 slidably extends through a hole 98 in an elbow-shaped member 99 fixed, such as by screws 100, to support plate 83, and an offset link 95, coupled to knob 22 by slip clutch 96, includes a cylindrical pin 97 which horizontally and slidably extends through oblong hole 94. Thus, with support indicated by arrow 25 causes pin 97 to slide in oblong hole 94 while ratchet 92 is rotated and pin 93 abuts and drives link 89. The resulting rotation of link 89 linearily drives plates 83 in the direction indicated by arrow 41.

Frame plate 61 pivotally supports a pawl 101, the pawl being biased against teeth 102 on the ratchet 92 by a tension spring 103 connected to pawl 101 and plate 61 (see FIG. 16). As a result, if after knob 22 has been rotated in the direction of arrow 24 the knob is rotated in the opposite direction pin 97 rotates the ratchet 92, thereby bring a leading edge of one of the teeth 102 into engagement with pawl 101. Thereafter, further rotation in the opposite direction causes the clutch 96 to slip. During rotation of ratchet 92 in the opposite direction pin 93 moves in hole 91 but does not rotate link 88 because the width of the hole 91 is greater the distance traveled by the pin 93 prior to engagement of a tooth by pawl 101.

The control means 86 also includes a clutch 87. Clutch 87 is supported by a mounting block 105 fixed to one side of frame plate 61. The other side of frame plate 61 supports (see FIGS. 10 and 13) a bracket 106 having a hole 107 aligned with a hole 108 in the plate for rotatably supporting a cylindrical link 109 extending through the hole 107 and 108. One end of link 109 is fixed to a handle 110 for rotating the link and the other end 111 of the link is fixed to a coupling 112 extending radially from the link. At each end of coupling 112 there is located a projecting cylindrical rod 113 and 114. Rods 113 and 114 are parallel to link 109 and are used, as more fully described below, to release the clutch 87 and disengage the pawl 101 when the handle is rotated in the direction indicated by the arrow 115.

Elbow member 99 rigidly supports a pin 116 snugly engaged with a hole 117 located at an end of a cylindrical rod 118 of the clutch. At least part of the rod 118 is slidably mounted in a cylindrical sleeve 119 having a flange 120 at the end closest the hole 117 and, between its ends, a plurality of spaced holes 121. Referring to FIGS. 10, 11, 12, and 14, the axes of holes 121 extend radially into the sleeve and lie in a theoretical plane perpendicular to the axis of the sleeve. Moreover, the distances between adjacent holes are equal and each of the holes 121 includes a tapered section 122. The tapered sections provide an abutment which, as more fully described below, permit bearings 123 slidably but snugly located in the holes 121 to protrude through the sleeve into contact with the rod 118 while blocking passage of the bearings into the center of the sleeve if rod 118 is removed.

The part of the outer surface of sleeve 119 which is located between the holes 121 and the flange 120 is slidably engaged with a cylindrical section 124 of a hole in a cylindrical member 125, and elastic means in the form of a compression spring 126 surrounding a section of the sleeve abuts the flange 120 at one end and at the end 127 of member 125. The hole includes a tapered section 128, aligned with cylindrical section 124, flaring away from the cylindrical section in a direction away from the flange, and bearings 123 have a diameter which is greater than the thickness of the wall of the sleeve. Thus, with sufficient compression in spring 126, as is desired, the bearings are brought into abutment with the rod 118 and the tapered section 128.

The end 129 of member 125 includes a notch 130 large enough to permit the passage of a bearing 123. This notch is used during assembly of the clutch to load the holes 121 with bearing. More specifically, in the loading operation the flange 120 is brought towards end 127, one of the holes 121 is brought under the notch, a bearing is dropped into the hole, and the sleeve 119 is rotated to align another hole with the notch. With this arrangement bearings 123 engaged with holes 121 are trapped by the tapered section 128 as other holes are being loaded.

Mounting block 105 includes a large bore 131 slidably engageable with member 125 and a small bore 132 aligned with bore 131, bore 132 being slidably engageable with sleeve 119. The outer surface of member 125 includes an annular groove 133 and set screws 134 extending through the mounting block engage the groove to lock member 125 with respect to the mounting block. It should be noted that the rod 118, the sleeve 119, and the cylindrical member 125, have a common axis which is parallel to the direction in which plate 83 is movable.

Operatively, when pin 90 applies a force in the direction of arrow 41 to elbow member 99 the force is transmitted via pin 116 to rod 118 and a resulting frictional force between rod 118 and bearings 123 moves the sleeve in the direction of arrow 41 (see FIGS. 10 and 11). Referring primarily to FIG. 11, with the bearings disengaged from the tapered section 128 rod 118 slides readily in the direction of arrow 41 and frictional force between rod 118 and sleeve 119 is balanced by spring 126. Thus, the sleeve 119 is initially moved slightly as the rod slides through the sleeve. Referring to FIG. 12, when the rod is subsequently brought to rest, spring 126 moves the sleeve in the direction indicated by arrow 42 and brings the bearings 123 back into contact with the rod and the tapered section. If a force tending to move the plate 83 backward is applied, the force is transmitted to rod 118 but frictional forces between the rod and the bearings and between the bearings and the tapered section, enhanced by a wedging action, prevent movement of the rod. Thus, it may be seen that the rod 118 is the clutched member of clutch 87 and when it is clutched the support plates 83 and 84 cannot be separated.

It should be noted that the spacing between the holes 121 and their alignment create an an equal distribution of the forces holding the rod, thereby minimizing excessive wear at localized points. Moreover, relative rotation between sleeve 119 and member 125 and rod 118 can be used to periodically change the contact surfaces used to clutch the rod, thereby minimizing localized wear. As is preferred, the tapered section 128, the rod 118, and the bearings are manufactured from hardened steel to add to the longevity of the clutch.

Referring to FIGS. 1, 13 and 14, when it is desired to permit backward movement of plate 83, handle 110 is moved in the direction indicated by arrow 115, rod 113 strikes the conical surface 136 of flange 120 and slidably moves the sleeve, thereby compressing the spring 126 and disengaging the bearings 123 from the tapered section 122. In addition, rod 114 lifts pawl 101 out of engagement with the teeth 102 of ratchet 92. As a result, the rod is not clutched, and knob 22 may be rotated to move the plate 83. When the handle is moved back spring 126 moves the sleeve and the rod is again clutched. It will be appreciated that because the bearings are slidably but snugly mounted in the holes a minimum amount of backlash is exhibited when the rod is clutched.

Referring to FIGS. 1 and 10, since plates 83 and 84 support page guides 18 and 19, respectively, and page guides 18 and 19 support caliper members 23 and 24, respectively, it will now be appreciated that rotation of knob 22 in the direction of arrow 25 will cause the caliper members to abut and compress the stack of paper sheets 17 therebetween. When, due to compression, the stack offers enough resistance to cause clutch 96 to slip further rotation of the knob in the same direction will not bring the plates 83 and 84 closer together and reverse rotation of knob 22 will not separate the plates unless handle 110 is actuated.

As shown in FIG. 15, strip guides 28 and 29 include slots 139, 140 (not all shown), and fasteners 141 extending through the slots slidably couple the strip guides 28 and 29 to plates 83 and 84, respectively. The slots are adapted to permit motion of the strip guides 28 and 29 toward and away from each other. Referring to FIGS. 15 and 16, motion between the guides is provided as follows. On the end diametrically opposed to the teeth 102 on ratchet 92 there is pivotally secured an end of a turnbuckle 142, the other end of the turnbuckle being pivotally secured to the end of the long leg of an L-shaped link 143 and to an end of a link 144. Link 144 is pivotally secured to the end of a short leg on an L-shaped link 145 and is pivotally secured, at a point between its ends, to a pin 146 fixed to frame plate 61. The end of the long leg of L-shaped link 145 is pivotally secured to a straight link 147. Link 147 is pivotally secured, at a point between its ends, by a pin 148 fixed to frame plate 61 and supports a poin 149 which is slidably engaged with a notch 150 at the end of the short leg of L-shaped link 143. The elbow sections of links 143 and 145 are pivotally secured by pins 152 and 153 to drive elbow links 154 and 155, respectively. Further, elongated slots 156 and 157 in links 154 and 155, respectively, are slidably engaged with a pin 158 on a biased link 159. With pin 158 stationary, rotation of knob 22 in the direction of arrow 24 causes the ratchet 92 to pull the turnbuckle 142 and pins 152 and 153 move with links 154 and 155, respectively, toward each other. As shown in FIG. 15, strip guides 28 and 29 include a slotted extensions 159 and 160 which slidably engage pins 153 and 152, respectively. Thus, rotation of knob 22 in the direction of arrow 24 moves the strip guides toward each other until, as described above, the stack of paper sheets 17 causes clutch 96 to slip. From the foregoing, it will be seen that the space between the strip guides 28 and 29 and between plates 83 and 84, when knob 22 is rotated in the direction of arrow 24 and clutch 96 slips, is dependent upon the thickness of the stack of paper sheets. After the stack of paper sheets 17 has been engaged, rotation of knob 22 in a direction opposite to arrow 24 causes pawl 101 to engage the first leading edge of the teeth 102 presented by the rotation of ratchet 92, and strip guides 28 and 29 are separated to substantially fixed positions. Three leading edges are provided by ratchet 92 and, therefore, three different separations may be set for the strip guides, each separation being obtainable for a different range of stack widths. In this connection, it should be noted that the magnitude of the separations may be set during assembly of the machine by appropriate rotation of turnbuckle 142.

The mechanism for clamping and plunging the stack of paper sheets 17 includes: the bipartite clamping means; drive means for moving the clamping means into and out of abutment with the stack of sheets; and means for moving the clamping means to drive the stack of sheets toward and away from the platens.

Referring to FIG. 8, the clamping means 27 and 27*a* includes a pair of parallel rods 163 and 164 rotatably coupled to frame plates 60 and 61, each of the rods 163 and 164 supporting parts for vertically moving the stack of paper sheets 17 when the rods are suitably rotated by said means for moving the clamping means. Structurally, rod 163 extends perpendicularly through horizontal slots 165 and 166 in frame plates 60 and 61, respectively, (see FIGS. 19 and 16) and flanges connected to rod 163 prevent axial movement of the rod while permitting rotation by the moving means. A pair of arms 165 and 166 rotatably mounted on rod 163 are rigidly connected to end sections 167 and 168, respectively, of an angle iron 169, and a pair of arms 170 and 171, rigidly connected to the rod, are coupled by tension springs 172 and 173 to the end sections 167 and 168, respectively. The ends of arms 170 and 171 are elbow shaped and extend under the arms 165 and 166, respectively. Therefore, rotation of the arms 170 and 171 downwardly, by rod 163, causes the springs 172 and 173 to stretch, thereby biasing angle iron 169 downwardly at both of its ends. Rotation of arms 170 and 171 upwardly bring their elbow ends into abutment with arms 165 and 166, respectively, thereby moving angle iron 169 upwardly. Angle iron 169 rigidly supports a plurality of similar paper drivers 174–177. Referring to driver 177 in FIGS. 8, 17 and 18, each of the drivers include a U-shaped member 178, one leg of the member being fixed to the angle iron 169 and the other leg of the member having a pair of extensions 179 and 180 to which a pin 181 is suitably fixed in parallel with the angle iron 169. Pin 181 rotatably supports an element 182 to which a flat friction pad 183 is attached for engaging the stack of paper sheets. Element 182 includes at its lower end a stop 184 which is brought into abutment with the U-shaped member by a wire spring 185, stop 184 being adapted to cooperate with spring 185 for keeping the pad 83 approximately in a vertical position prior to its engagement with a stack of paper sheets. A screw 186 threadably engaged with the angle iron and said one leg of the member 178 serves to reinforce the U-shaped member so that it is not distorted when the clamping means are brought into abutment with a stack of paper sheets and to keep the pad 183 at a predetermined distance from angle iron 169. Screw 186 is secured by nut 187. Rod 164 similarly supports fixed arms, rotatable arms fixed to an angle iron, springs for biasing the bracket and drivers fixed to the bracket, each of the drivers being opposite one of the drivers 174–177. Thus, when the clamping means 27 and 27*a* are actuated the vertically disposed stack of paper sheets is compressed by spaced sets of opposing drivers. In the clamping process, because the friction pads are almost vertically disposed, vertical motion is not imparted to the stack of paper sheets. It should be noted that the angle irons are driven at their end sections and that, as a result, in the automatic binding cycle the spaced sets of drivers can uniformly press an edge of the stack of paper sheets against the low tack adhesive on the strip section.

The means for driving the stack of sheets toward and away from the platens are shown in FIGS. 8 and 19, and include: the shaft 38 driven by motor 37 (see FIG. 3), the cam 43 mounted on shaft 38, and linkage 44. As best shown in FIG. 19, linkage 44 comprises a T-bar 190 having a vertical slot 191 in its stem section and a horizontal slot 192 and 193 in each of its arm sections. T-bar 190 is slidably coupled to the outside of frame plate 60 by a bolt 194 which serially extends through a spacer (not shown), through slot 191, and through a washer 195, bolt 194 being secured by a lock washer 196. In addition, T-bar 190 is slidably coupled to the outside of frame plate 60 by a bolt 197 which serially extends through a spacer 199 (see FIG. 8) and through a vertical slot 198 in frame plate 60, the bolt being secured by a lock washer. Thus, T-bar 190 is movable vertically. A follower link 201 pivotally connected at one end to plate 60 and at the other end slidably to the stem of T-bar 190 includes a follower 202 which is biased downwardly against cam 43 by a tension spring 203 connected to the frame plate and the T-bar. As a result, the vertical position of the T-bar is controlled by the cam 43. A crank arm 205 rigidly connected to rod 163 is slidably coupled to the T-bar 190 by a bolt 206 which serially extends through slot 193, a washer 208 (see FIG. 8) and a hole (not shown) in the crank arm, the bolt 206 being secured by a nut 209. Similarly, a crank arm 221 rigidly connected to rod 164 is slidably coupled to the T-bar 190 by a bolt 210 which serially extends through slot 192, a washer 212 (see FIG. 8) and a hole (not shown) in the crank arm, the bolt 210 being secured by a nut 226. Thus, the clamping means 27 and 27*a* cannot rotate while the T-bar is stationary but can be moved toward or away from each other. In fact, referring to FIG. 16, elbow links 154 and 155 are coupled to rods 164 and 165 by springs 213 and 214, respectively, and when knob 22 is rotated in the direction of arrow 24 the clamping means are moved towards each other. Thereafter, reverse rotation of knob 22 to set the strip guides eases the tension in the springs and the clamping means are in position to be acted on by means for moving the clamping means into abutment with the stack of paper sheets.

The means for moving the clamping means into abutment with the stack of paper sheets includes the shaft 38 driven by motor 37 (see FIG. 3), the cam 39 mounted on shaft 38, and linkage 40. Referring to FIG. 16, linkage 40 comprises: a bracket 215 fixed to frame plate 61 for slidably engaging link 159; a tension spring 216 connected to the bracket and link for biasing the link upwardly; a threaded link extension 217 pointing downwardly and supporting a nut 218; and a follower link 219 pivotally connected at one end and in abutment with the nut 218 at the other. Follower link 219 includes a follower 220 which is kept in abutment with cam 39 by the action of tension spring 216. The tension in the spring may be adjusted by varying the position of nut 218 on extension 217. From the foregoing, it may be seen that rotation of cam 39 can be used to drive link 159 downward, thereby causing elbow links 154 and 155 to pivot about pins 152 and 153, respectively. Such rotation drives the clamping means into abutment with a stack of paper sheets therebetween and stresses the linkage. With the linkage shown in FIG. 16 stressed the position of the pins 152 and 153 on a cycle to cycle basis is repeatable and, therefore, the space between the strip guides favors the use of standard size adhesive strip sections. With the book clamped, as previously stated, a strip section 47 is inserted, the clamping means lift the stack and the plate 21 on which the stack rested is removed by a cam 45 mounted on motor driven shaft 38 and linkage 45 (see FIG. 5).

The strip guides 28 and 29 and the rods 163 and 164, to name a few machine components, are elongated members which in the operation of the machine are moved toward and away from each other but remain in parallel with each other. Parallelism is maintained by, for example, providing adjacent frame plate 60 linkage such as is shown in FIG. 16, by coupling the drive provided by the ratchet 92 and the cam 39 to the linkage, and by coupling the linkages to the adjacent parts of the rods and strip guides.

Referring to FIG. 8, plate 21 is slidably coupled by bolts 222 and nuts 223 to slots 224 and 225 which are parallel to the frame plates 60 and 61. In view of the detailed structure set forth of linkage responsive to springs and to cams on motor driven shaft 38, and because linkage 45 similarly includes: a support, a link pivotally coupled to the support, said link being connected at one end to the plate 21 and at the other end to a cam follower, and a spring secured to the support and the link for biasing the cam follower against cam 45, it is believed one reasonably skilled in the art can proivde the specific structure and a figure showing the details of linkage 45 has not been included herein.

While plate 21 is being withdrawn and the stack of paper sheets is in vertical motion, the platens 12 and 13 (see FIG. 9) are set in motion by cam 48 mounted on motor driven shaft 38 and linkage 49 (see FIG. 5). Referring to FIG. 9, elbow links 227 and 228 are rigidly coupled to shafts 229 and 230, respectively, shafts 229 and 230 being rotatably supported (not shown) by plates 72 and 76, respectively. Links 227 and 228 include slots 231 and 232, respectively, the slots being maintained horizontally by a pin 233 extending therethrough. Pin 233 is fixed to a follower link 234 rotatably supported by a shaft 235 coupled to the frame plates, the follower link having a follower 236 which rides on cam 48. Shaft 229 rigidly supports an arm 238 and rotatably supports a slotted link 239, link 239 and arm 238 being coupled by a spring 240. Similarly, shaft 230 rigidly supports an arm 241 and rotatably supports a slotted link 242, link 242 and arm 241 being coupled by a spring 243. Slotted links 239 and 242 are slidably coupled to pins on platens 13 and 12, respectively. Platens 13 and 12 are slidably coupled to plates 84 and 83, respectively, by fasteners 141 extending through slots 246 (only one shown) in the platens. Thus, if follower 236 is driven downwardly by cam 48, elbow links 227 and 228 are rotated, slotted links 239 and 242 are rotated by springs 240 and 243, respectively, and platens 12 and 13 are brought together. Downward motion of follower 236 also causes the follower link to stretch a spring 244 connected to a pin 245 on frame 60 (not shown). Therefore, when the follower is not urged downwardly by the cam 48 the spring 244 restores the linkage 49 to the position shown in FIG. 9. In restoring the linkage, the arms 238 and 241 abut extensions 249 and 250, respectively, on the slotted links and provide a maximum separation between the platens. It should be noted that the linkage described is connected to the platens at one of its ends and that similar linkage is connected to the other ends (not shown) to maintain substantially the same spacing throughout the length of the platens 12 and 13.

In FIG. 9 it may be seen that the maximum space between the platens 12 and 13 is determined by the separation between the support plates 83 and 84 and, as previously stated, the separation of the support plates is determined by the thickness of a stack of sheets to be bound. Cam 48 is designed such that one of its lobes 48*a* drives the platens toward each other so that the strip section can be preheated thereon. Thereafter, cam section 48*b* partially moves the platens slightly apart. In this position the platens can be separated slightly by the entry of the stack and strip and, therefore, snugly wrap the edge of the stack with the strip. Subsequently, lobe 48*c* biases the platens 12 and 13 against the strips to fix it to the stack.

Figure 7:
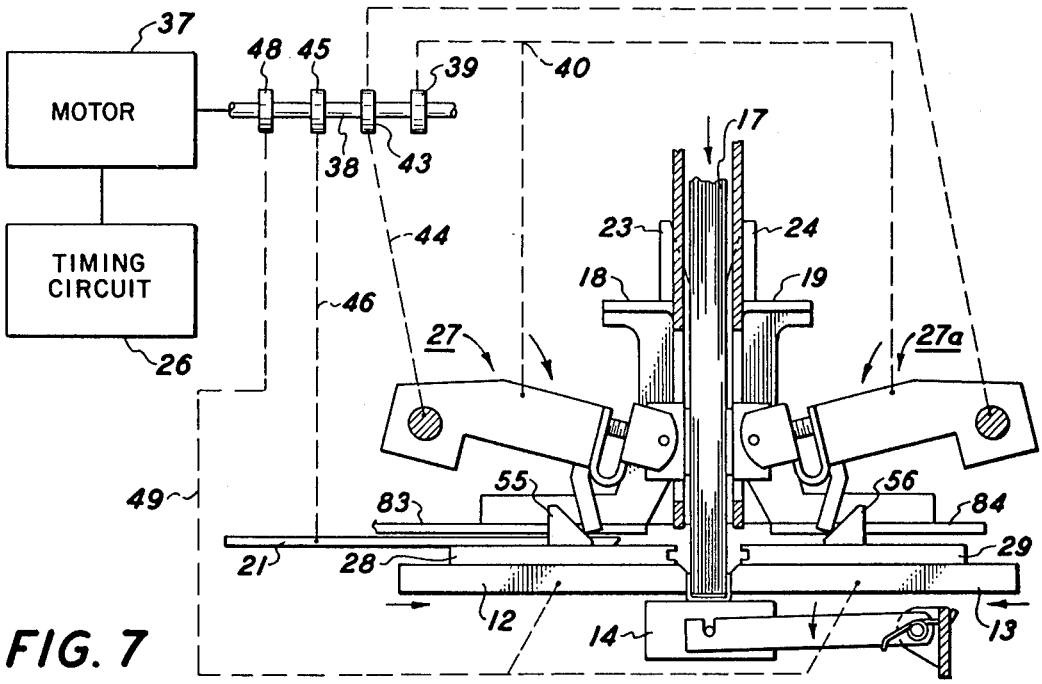

In view of the foregoing description, it should be appreciated that the use of the cam driven T-bar arrangement permits movement of the clamping means against the stack of sheets and rotates the clamping means as much as is required to bring the clamping means 27 and 27*a* into abutments 55 and 56, respectively (see FIG. 7). In turn, when the clamping means contact abutments 55 and 56 and platens 12 and 13 press against the adhesive strip, the pressing is performed against at least the upper part of the strip, thereby obviating the occurrance of free strip edges in the finished book and minimizing contamination of the platens with adhesive from the strips. The latter tends to prevent marring with adhesive subsequently bound books.

It is to be understood that the description herein of a preferred embodiment, according to the invention, is set forth as an example thereof and is not to be construed or interpreted as a limitation on the claims which follow and define the invention.

I claim:

1. Apparatus for applying a piece of adhesive strip to a stack of sheets having a thickness within one of several thickness ranges, the width of the adhesive strip to be applied being dependent on the thickness range to which the thickness of the stack of sheets corresponds, comprising:

a. a pair of strip guides;

b. means, responsive to the thickness of the stack of sheets, for moving the strip guides to initial positions, said means including linkage means;

c. bipartite clamping means;

d. means, coupled to the linkage means, for moving the clamping means into engagement with the stack of sheets and for stressing play out of said linkage means, thereby moving the strip guides into one of a set of several sets of positions, each set corresponding to one of the thickness ranges, said one of a set of positions being suitable for supporting an adhesive strip having a width which is suitable for binding the engaged stack of sheets;

e. an arrangement of platens;

f. means for rotating the clamping means, thereby moving an edge of the clamped stack of sheets into abutment with one side of the adhesive strip and for moving the other side of the adhesive strip into abutment with at least one of the platens; and g. means for biasing the platens against the other side of the strip to fix the strip to the stack of sheets, thereby forming a book.

2. Apparatus as defined in claim 1 wherein said means for moving the strip guides to initial positions includes: a clutch arrangement; and means, responsive to the thickness of the stack of sheets, for causing the clutch arrangement to engage, the linkage means being responsive to the engagement of the clutch.

3. Apparatus as defined in claim 2 wherein the clutch arrangement includes a pawl and ratchet; and wherein the means for causing the clutch arrangement to engage cause the pawl to engage one of a plurality of teeth on the ratchet, each of the thickness ranges corresponding to a different one of the teeth.

4. Apparatus as defined in claim 2 wherein the linkage means are slidably coupled to the strip guides.

5. Apparatus as defined in claim 4 wherein said means for moving the clamping means include a motor and a cam arrangement coupling the motor to the linkage means, said linkage being stressed by the motor when the clamping means engage the stack of sheets.

6. Apparatus as defined in claim 5 wherein the clutch arrangement includes a pawl and ratchet; and wherein the means for causing the clutch arrangement to engage cause the pawl to engage one of a plurality of teeth on the ratchet, each thickness range corresponding to a different one of the teeth.

7. Apparatus as defined in claim 6 the ratchet is coupled to the linkage by a turnbuckle for setting the actual distance between the strip guides when they are in said one of several sets of positions.

8. Apparatus as defined in claim 7 wherein said pawl is pivotally coupled to a frame; wherein the pawl is biased into engagement with the ratchet by a spring; and wherein the ratchet is driven by a slip clutch.

* * * * *